United States Patent [19]

Tada et al.

[11] Patent Number: 4,692,123

[45] Date of Patent: Sep. 8, 1987

[54] OUTBOARD MOTOR

[75] Inventors: Yukio Tada; Hiroshi Umeno; Yasuhiro Sugimoto; Hideo Oka, all of Saitama, Japan

[73] Assignee: Honda Giken Kogyo Kabushiki Kaisha, Tokyo, Japan

[21] Appl. No.: 931,881

[22] Filed: Nov. 17, 1986

Related U.S. Application Data

[63] Continuation of Ser. No. 639,295, Aug. 10, 1984, abandoned.

[30] Foreign Application Priority Data

| | | | |
|---|---|---|---|
| Aug. 10, 1983 | [JP] | Japan | 58-146979[U] |
| Aug. 23, 1983 | [JP] | Japan | 58-129301[U] |
| Dec. 3, 1983 | [JP] | Japan | 58-187176[U] |
| Mar. 1, 1984 | [JP] | Japan | 59-29679[U] |

[51] Int. Cl.[4] ..... B63H 21/26

[52] U.S. Cl. ..... 440/77; 440/900; 123/195 P

[58] Field of Search ..... 440/76, 77, 88, 900; 123/195 AC, 198 E, 196 W, 195 P, 41.62, 41.63, 41.65, 41.7; 30/381; 180/54 R, 54 A, 69.1, 69 R; 114/144 R

[56] References Cited

U.S. PATENT DOCUMENTS

| | | | |
|---|---|---|---|
| D. 135,329 | 3/1943 | Kiekhaefer | 440/76 |
| 2,256,831 | 9/1941 | Karey | 440/88 |
| 2,501,470 | 3/1950 | Krueger et al. | 440/77 |
| 3,195,530 | 7/1965 | Heidner | 440/77 |
| 3,692,006 | 9/1972 | Miller et al. | 440/900 |
| 4,233,043 | 11/1980 | Catterson | 123/198 E |

*Primary Examiner*—Jeffrey V. Nase
*Assistant Examiner*—Edwin L. Swinehart
*Attorney, Agent, or Firm*—Armstrong, Nikaido, Marmelstein & Kubovcik

[57] ABSTRACT

An outboard engine has a power unit, an extension case extending vertically and having its upper end coupled to the power unit, and a propeller mounted on the lower end of the extension case and driven by the power unit. The power unit comprises an internal combustion engine having a vertically extending crank shaft and a cylinder having its axis extending horizontally, and a cover assembly covering the internal combustion engine. The axis of the cylinder is inclined to one side with respect to the axis of the propeller when viewed in plan. The outboard engine can be handled with utmost ease since it can be laid down during storage or shipment without being drained of engine oil.

23 Claims, 11 Drawing Figures

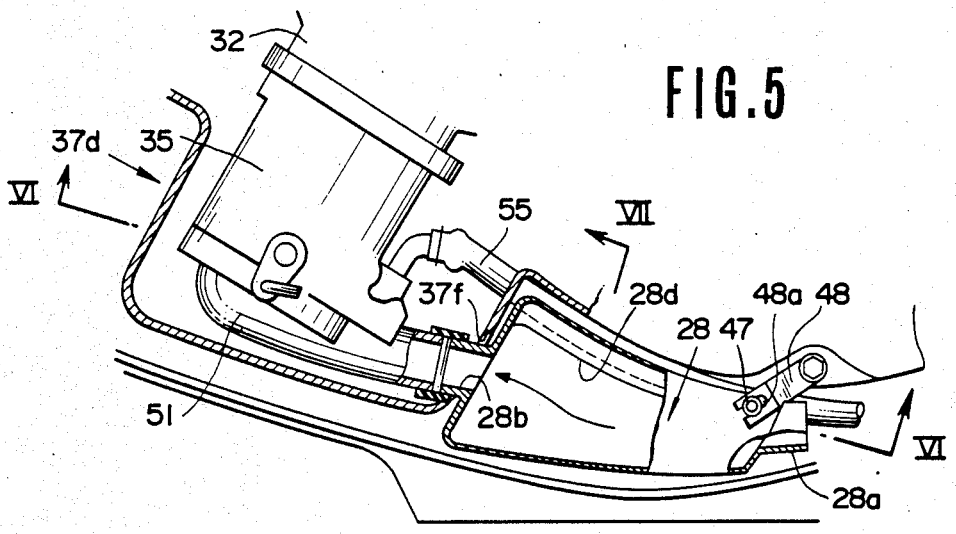
FIG.5
FIG.6
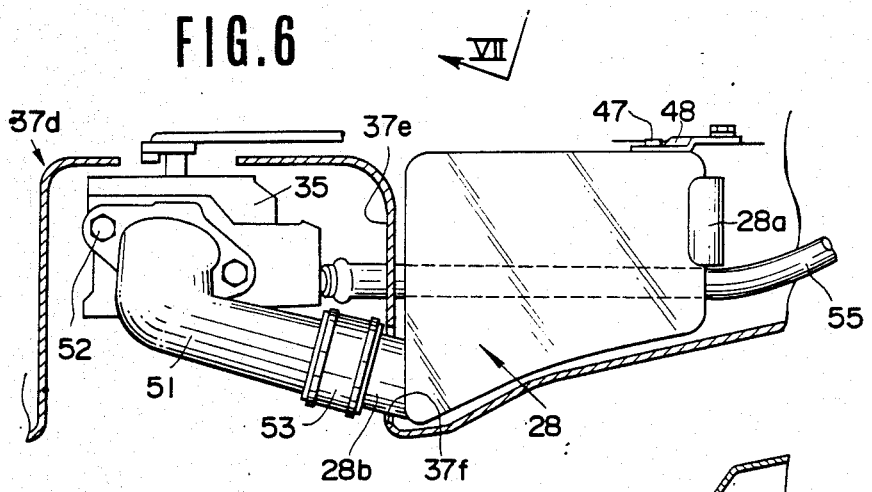
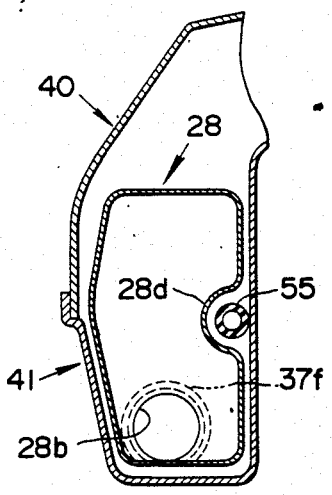
FIG.7

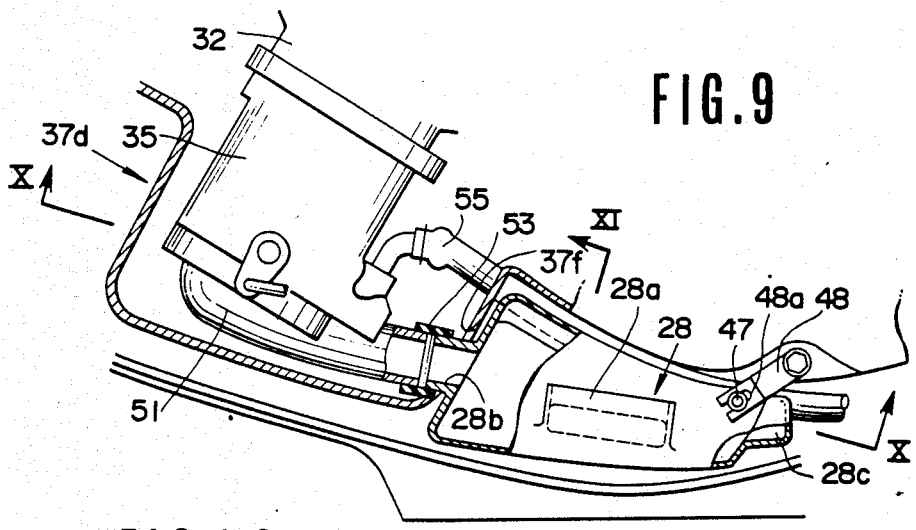
FIG.9
FIG.10
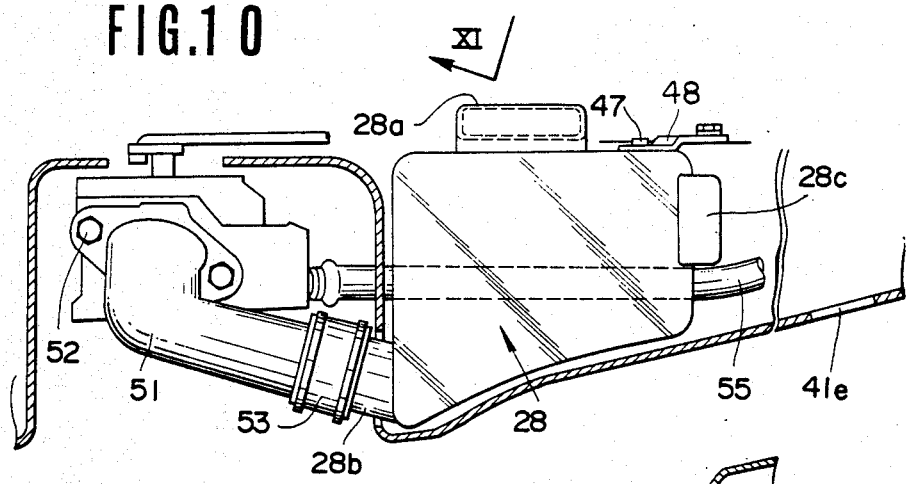
FIG.11
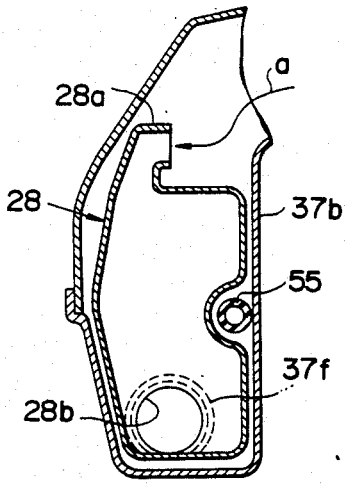

OUTBOARD MOTOR

This application is a continuation of application Ser. No. 639,295 filed Aug. 10, 1984, now abandoned.

BACKGROUND OF THE INVENTION

1. Field of the invention:

The present invention relates to an outboard engine, and more particularly to a power unit in an outboard engine.

2. Description of the Prior Art:

Outboard engines are frequently carried around and stored on land since are generally used in various kind of boats by being secured to such boats in the manner that they can be easily detached from the boats. It has been customary practice during transportation or storage to keep the outboard engine upright with the aid of a support or drain engine oil so that no engine oil will find its way into the engine cylinder and hence no engine trouble will be caused. Therefore, it has been troublesome to handle the outboard engine while it is being transported or stored.

It is desirable for easier handling that the outboard engine be as compact as possible. For protecting the engine from water, particularly sea water, it is necessary to surround the engine with an engine cover. If the engine cover were too small for the engine, intake air drawn into the engine would be affected by the heat generated by the engine, resulting in a lowered charging efficiency of the engine and a reduced engine power output.

The outboard engine is also required to separate sea water spray, dust, or other foreign matter from intake air so that the service life of the engine will not be impaired. Another requirement is that since the operator is positioned just in front of the engine during operation of the engine, noise produced when intake air is drawn into the engine be reduced to as low a level as possible to lessen the fatigue of the operator. However, it has proven that these requirements are contradictory to the demand for more compact outboard engines.

SUMMARY OF THE INVENTION

The present invention has been achieved in an effort to eliminate the above prior problems.

According to the present invention, an outboard engine includes a power unit, an extension case extending vertically and having an upper end coupled to the power unit, and a propeller mounted on a lower end of the extension case and drivable by the power unit. The power unit comprises an internal combustion engine having a vertically extending crank shaft and a cylinder having a horizontal axis, and a cover assembly covering the internal combustion engine. The axis of the cylinder is inclined to one side with respect to an axis of the propeller when viewed in plan. The outboard engine can be handled with utmost ease since it can be laid down during storage or shipment without being drained of engine oil.

The power unit includes a handlebar disposed on one side thereof toward which the axis of the cylinder is inclined, and the cover assembly includes a foot for laying down the outboard engine thereon, on one side thereof away from which the axis of the cylinder is inclined.

The cover assembly is in the form of a shell defining a cavity therein, and has an integral shroud on a lower surface thereof for cooling the internal combustion engine by cooperating with a fan, the cover assembly thus composing an air intake system of the power unit. This arrangement increases a charging efficiency of the internal combustion engine, reduces noise, and makes the outboard engine compact in construction.

Furthermore, the cover assembly has an air intake chamber of the internal combustion engine for preventing sea water spray from being drawn into a combustion chamber of the internal combustion engine.

It is an object of the present invention to provide an outboard engine which can be laid down during shipment or storage without being drained of engine oil.

Another object of the present invention is to provide an outboard engine which has an increased charging efficiency, produces less noise, and is compact in construction.

Still another object of the present invention is to provide an outboard engine having a means for preventing sea water spray, dust or other foreign matter from entering an engine combustion chamber.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 5 is an enlarged plan view of an air intake chamber in the outboard engine illustrated in FIG. 1;

FIG. 6 is a cross-sectional view taken along line VI—VI of FIG. 5;

FIG. 7 is a cross-sectional view taken along line VII—VII of FIG. 5;

FIG. 9 is an enlarged plan view of an air intake chamber in the outboard engine shown in FIG. 8;

FIG. 10 is a cross-sectional view taken along line X—X of FIG. 9; and

FIG. 11 is a cross-sectional view taken along line XI—XI of FIG. 9.

DESCRIPTION OF THE PREFERRED EMBODIMENTS

Figure 1:
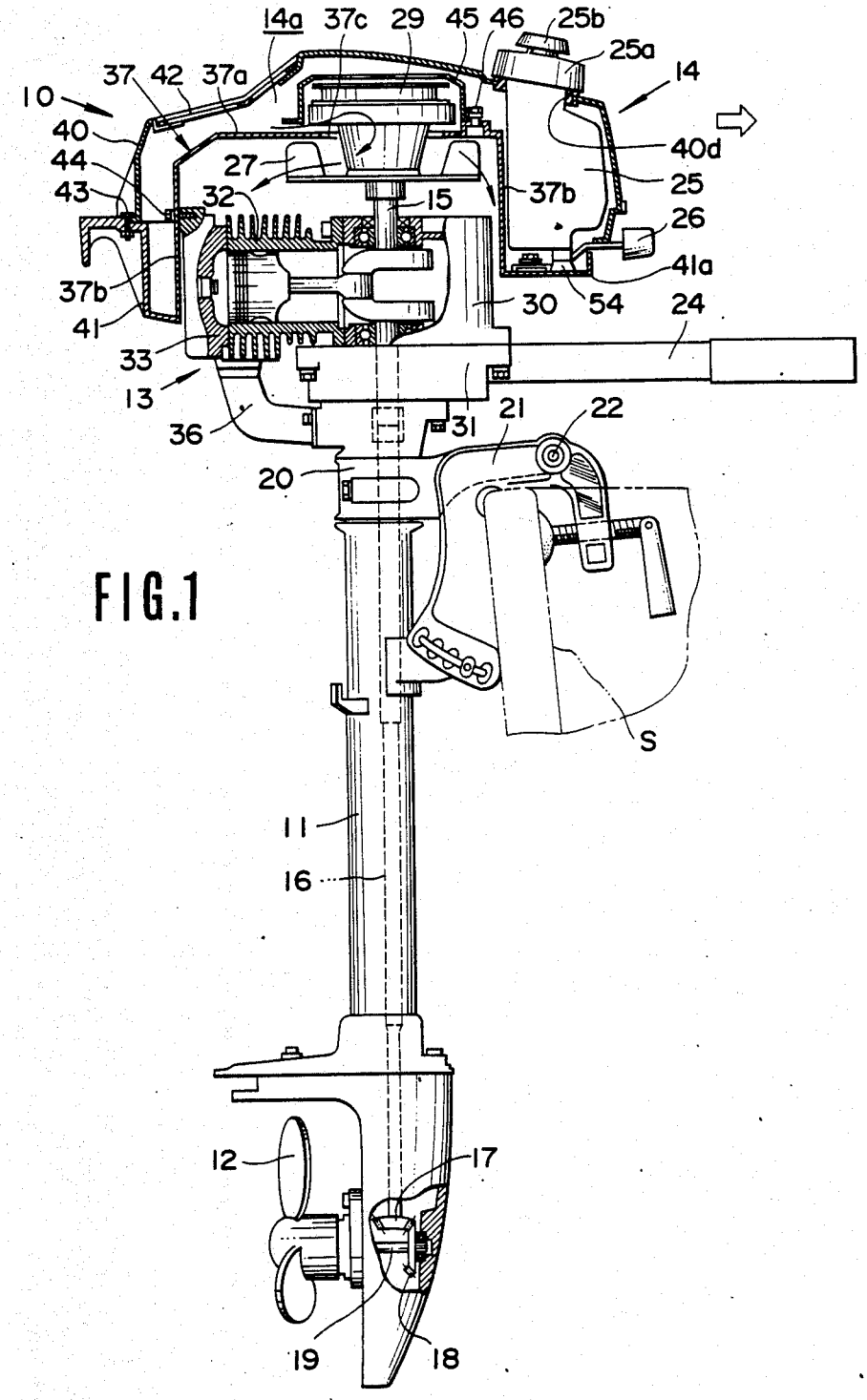
FIG. 1 is a side elevational view, partly in cross section, of an outboard engine according to a first embodiment of the present invention.

As shown in FIG. 1, an outboard engine according to an embodiment of the present invention generally comprises a power unit 30, an extension case 11 extending vertically and having an upper end connected to the power unit 10, and a propeller 12 mounted on a lower end of the extension case 11 and drivable by the power unit 10. The power unit 10 is essentially composed of an internal combustion engine 13 and a cover assembly 14 mounted on and covering the internal combustion engine 13. The upper end of the extension case 11 is fixed to a lower surface of the internal combustion engine 13. The internal combustion engine 13 includes a vertically extending crank shaft 15 having a lower end coupled to an upper end of a vertical drive shaft 16 disposed in the extension case 11. The vertical drive shaft 16 supports on a lower end thereof a bevel gear 17 held in driving mesh with a bevel gear 18 mounted on a horizontally extending shaft 19 of the propeller 12. Therefore, the torque is transmitted from the crank shaft 15 of the internal combustion engine 13 to the propeller 12 through the vertical drive shaft 16, the intermeshing bevel gears 17, 18, and the horizontal shaft 19.

The extension case 11 is angularly movably supported on a swivel case 20 which is vertically tiltably coupled by a pivot shaft 22 to a stern bracket 21 that will be clamped to the stern of a boat S. The outboard engine can be directed by a handlebar 24 secured to a casing of the internal combustion engine 13 for steering the boat S.

The power unit 10 will be described in greater detail with reference to FIGS. 1 through 3. The power unit 10 includes, in addition to the internal combustion engine 13 and the cover assembly 14, a fuel tank 25, a throttle lever 26, a cooling fan 27, an air intake chamber 28, and a recoil starter 29. These additional power unit members are all mounted on the internal combustion engine 13 or the cover assembly 14.

As illustrated in FIG. 1, the casing of the internal combustion engine 13 is constructed of a crank case 30, an oil pan 31 fastened to a lower side of the crank case 30, and a cylinder barrel 32 and a cylinder head 33 which are fastened to a rear end of the crank case 30 and tilted to one side. The crank shaft 15 is supported by the crank case 30 and extends vertically. A cylinder is composed of the cylinder barrel 32 and the cylinder head 33 and has a horizontal axis. Intake and exhaust valves 34 are disposed in the cylinder barrel 32 on one side thereof, and jointly constitute a valve mechanism of the side valve type. The cylinder head 33 supports thereon an ignitionplug electrically connected to an ignition system (not shown). The fan 27 and the recoil starter 29 are secured to an upper end of the crank shaft 15. The cylinder barrel 32 has an intake port to which a carburetor 35 is connected and an exhaust port to which one end of an exhaust pipe 36 is connected. The exhaust pipe 36 extends through the extension case 11 and has the other end positioned underwater, thus constituting an underwater exhaust system.

The internal combustion engine 13 is forcibly cooled by the fan 27. A shroud 37 is formed on a lower side of the cover assembly 14 for guiding a cooling air flow. The shroud 37 has a top wall **37*a* and a surrounding wall 37*b* which cover upper and side surfaces of the engine 13 and the fan 27. The top wall 37*a* has a cooling air inlet port 37*c* defined therein adjacent to the fan 27 for introducing air into the shroud 37. There is a clearance gap defined between the side surface of the internal combustion engine 13 and the surrounding wall 37*b* for discharging air from the shroud 37**.

Figure 2:
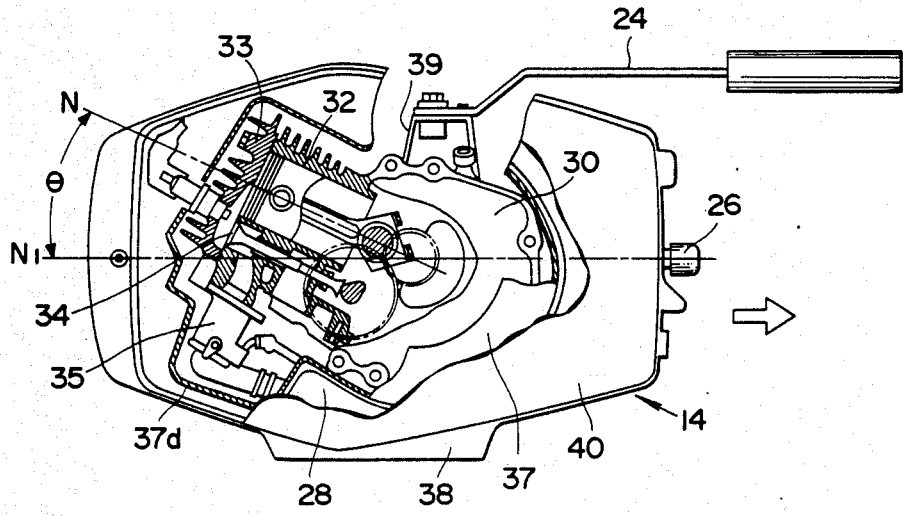
FIG. 2 is a plan view, partly in cross section, of the outboard engine shown in FIG. 1.
Figure 3:
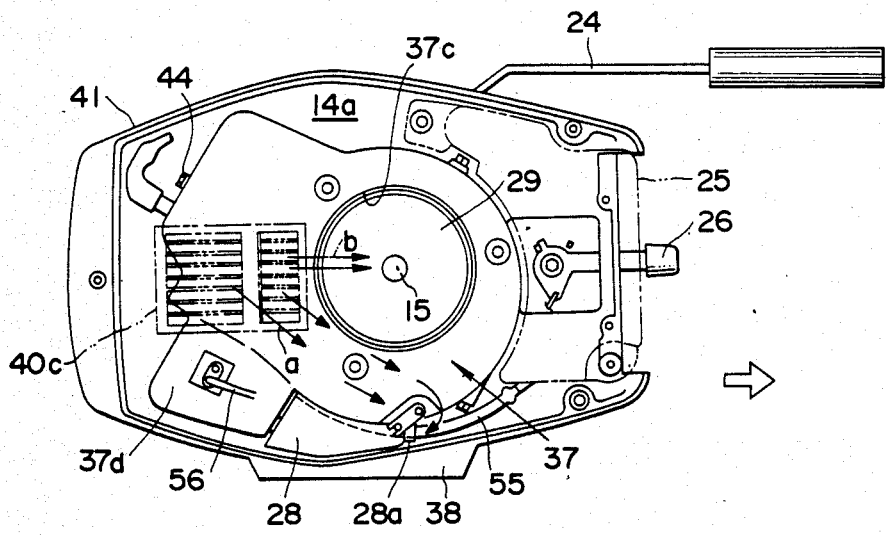
FIG. 3 is a plan view showing the interior of a cover assembly of the outboard engine of FIG. 1.
Figure 4:
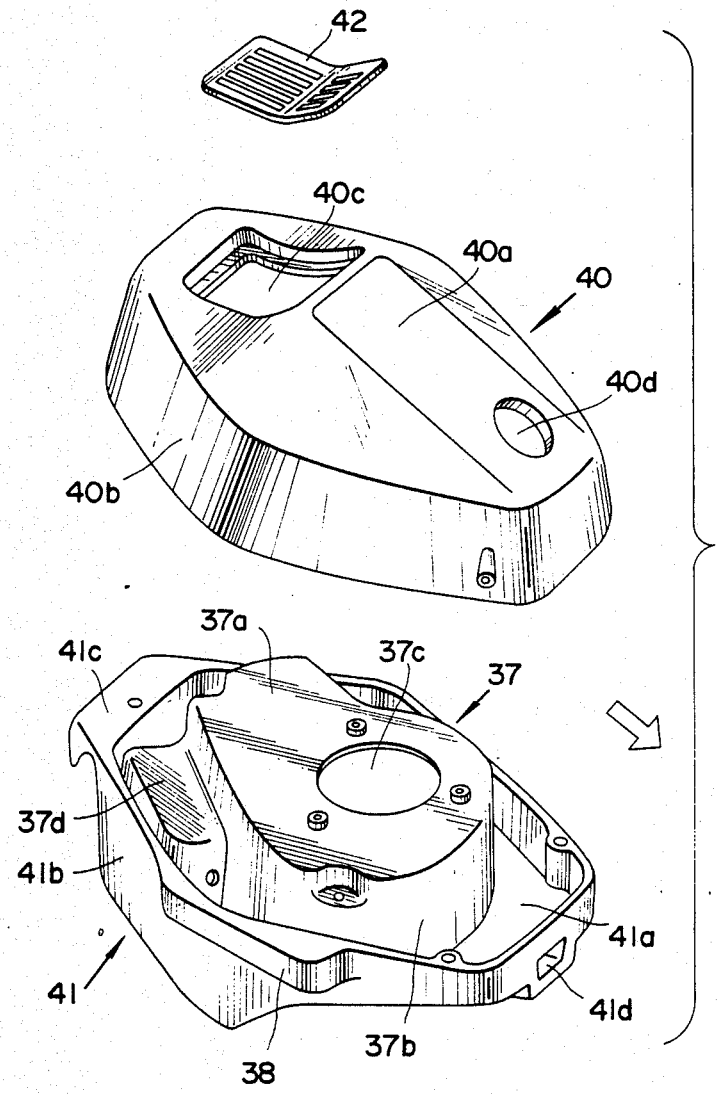
FIG. 4 is an exploded perspective view of the cover assembly of the outboard engine of FIG. 1.

As illustrated in FIGS. 2 and 3, the cover assembly 14 has on one side thereof a foot 38 which will be held in contact with a floor when the outboard engine is to be laid down on the floor. The power unit 10 has a handlebar 24 on a side thereof opposite to the foot 38. The handlebar 24 is coupled to a bracket 39 mounted on the oil pan 31 of the engine 13.

With the outboard engine according to the present invention, the engine cylinder has its axis N inclined through an angle $\theta$ (preferably about 30°), when viewed in plan as shown in FIG. 2, from a longitudinal center line passing through the center of the crank shaft 15, that is, from an axis $N_1$ of the propeller 12. The cylinder barrel 32 is thus tilted toward one outer wall of the cover assembly 14, leaving a space between the cylinder barrel 32 and an opposite outer wall of the cover assembly 14. The carburetor 35 is disposed in the space. As a consequence, efficient space utilization within the cover assembly 14 is achieved. More specifically, the required length of the outboard engine is smaller than that of the conventional outboard engine arrangement in which a cylinder barrel is directed longitudinally and parallelly with the axis $N_1$ of a propeller. In such conventional outboard engine arrangement, a carburetor is generally mounted either on a side of a cylinder extending longitudinally and parallelly with the axis $N_1$ or on an upper surface of the cylinder, and hence a cover surrounding the carburetor is increased in lateral dimensions or upward dimensions. With the outboard engine of the present invention, however, the cover has a reduced width and smaller vertical dimensions while defining a large space on one side away from which the cylinder barrel 32 is inclined, with the carburetor 35 disposed in such a large space.

According to the present invention, therefore, the components of the power unit are so arranged that the power unit including the cover assembly has reduced dimensions in longitudinal, vertical, and transverse directions, and the outboard engine has a compact outer profile.

The handlebar 24 of the power unit 10 is disposed on one side thereof toward which the cylinder barrel 32 is inclined, and the foot 38 of the cover assembly 14 is disposed on one side thereof away from which the cylinder barrel 32 is inclined. For transporting or storing the outboard engine, it is detached from the boat, and laid down with the foot 38 facing downwardly or placed on a floor. When the outboard engine is thus laid down, the handlebar 24 is located upwardly of the outboard engine and hence is not an obstacle to efforts to place down the outboard engine. Under the laid-down condition, the cylinder is oriented obliquely upwardly because of the inclined axis of the cylinder barrel, and oil in the oil pan 31 remains therein and will not enter the combustion chamber in the cylinder, nor in the carburetor 35 and the ignition plug. The outboard engine of the invention can be stored or transported in a laid-down posture wihtout being drained of oil, and is not required to be supported vertically or obliquely with a support during storage or shipment.

The cover assembly 14 will be described in greater detail with reference to FIGS. 1 through 4. The cover assembly 14 is composed of an upper cover 40 and a lower cover 41. The upper cover 40 has a top wall **40*a* and a surrounding wall 40*b*, while the lower cover 41 has a bottom wall 41*a* and a surrounding wall 41*b*. The upper and lower covers 40, 41** are formed of reinforced synthetic resin.

The upper cover 40 has an air inlet port **40*c* defined in a rear portion of the top wall 40*a* and having a grille 42, and an opening 40*d* defined in a front portion of the top wall 40*a* for allowing a fuel inlet pipe 25*a* of the fuel tank 25 to project therethrough. The lower cover 41 has the air cooling shroud 37 formed centrally on the bottom wall, 41*a* thereof, the foot 38 being formed on a portion of the surrounding wall 41*b*. The surrounding wall 41*b* has a carrier grip 41*c* on a rear portion thereof and a opening 41*d* defined in a front portion thereof for permitting the throttle lever 26** to project therethrough.

The upper and lower covers 40, 41 are coupled together by bolts and nuts 43 joining the surrounding walls 40*b*, 41*b* and jointly constitute the shell-shaped cover assembly 14 having a cavity 14*a* defined therein. The cover assembly 14 is fixed to the internal combustion engine by a bolt 44. The recoil starter 29 mounted on the upper end of the crank shaft 15 projects through the cooling air inlet port 37*c* in the shroud 37 into the cavity 14*a*, the recoil starter 29 being covered with a starter cover 45 secured by a bolt 46 to the top wall 37*a* of the shroud 37.

As illustrated in FIGS. 2, 5, and 6, the air intake chamber 28 which communicates with the carburetor 35 is disposed in the cavity 14*a* in the cover assembly 14. The carburetor 35 mounted on the cylinder barrel 32 is positioned in a rear rightward projecting portion 37*d* of the shroud 37. The air intake chamber 28 is complementarily fitted in a substantially wedge-shaped (as viewed in plan) space positioned in front of the projecting portion 37*d* and defined by the surrounding wall 37*b* and the righthand portion of the surrounding wall 41*b* of the lower cover 41. The air intake chamber 28 has a short inlet tube 28*a* on a front end thereof for introducing air therethrough and a short outlet tube 28*b* on a rear end thereof for discharging air therethrough. The air intake chamber 28 is elongate in the longitudinal direction such that the short inlet tube 28*a* is spaced forward remotely from the air inlet port 40*c* and the short inlet tube 28*a* opens away from the air inlet port 40*c*, the short inlet tube 28*a* projecting from a front surface facing forward of the outboard engine. The short outlet tube 28*b* projects through an air discharge port 37*f* defined in the projecting portion 37*d* of the shroud 37 into the shroud 37 toward a position close to the carburetor 35.

The air intake chamber 28 has an integral support pin 47 with an enlarged head, disposed on an upper surface adjacent to the short inlet tube 28*a*. A support arm 48 pivotally attached to the shroud 37 has an U-shaped recess 48*a*. The support pin 47 has a neck engaging in the U-shaped recess 48*a*. Thus, the air intake chamber 28 is secured to the cover assembly 14 by the support arm 48.

As shown in FIGS. 5 and 6, the carburetor 35 and the air intake chamber 28 are held in communication with each other by an air conduit 51 having one end fastened by bolts 52 to the carburetor 35, a bent intermediate portion, and an opposite end directed forward of the outboard engine and coupled by a rubber joint 53 to the short outlet tube 28*b* of the air intake chamber 28.

The fuel tank 25 is disposed in the cavity 14*a* in the cover assembly 14. As shown in FIGS. 1 and 3, the fuel tank 25 is disposed in a space defined by a front portion of the surrounding wall of the shroud 37 and front walls of the lower and upper covers 41, 40. The fuel tank 25 is supported by a resilient support member 54 on the bottom wall 41*a* of the lower cover 41. The fuel inlet pipe 25*a* of the fuel tank 25 is exposed to the exterior through the opening 40*d* defined in the top wall 40*a* of the upper cover 40, with a cap 25*b* mounted on the upper open end of the fuel inlet pipe 25*a*.

A fuel pipe 55 (FIGS. 3, 5, and 6) extends from the fuel tank 25 alongside of the air intake chamber 28 through a side wall 37*e* of the projecting portion 37*d* of the shroud 37. To avoid physical interference with the air intake chamber 28 and define a path of the fuel pipe 55, the air intake chamber 28 has in a side surface thereof a channel 28*d* accommodating therein the fuel pipe 55.

The carburetor 35 has a float chamber supplied with fuel from the fuel tank 25 through the fuel pipe 55. The carburetor 35 also has a throttle valve openable and closable through an interlink mechanism 56 composed of a link and a Bowden wire by the operation of the throttle lever 26 pivotally mounted on the bottom wall 41*a* of the bottom cover 41 directly below the fuel tank 25.

The cover assembly 14 as described above composes the air intake system of the power unit and functions as folows: During operation of the internal combustion engine 13, air is introduced through the air inlet port 40*c* into the cavity 14*a* in the cover assembly 14 and is divided into a first air flow a (FIG. 3) directed obliquely toward the air intake chamber 28 under suction of the internal combustion engine 13 and a second air flow b directed straight toward the cooling air inlet port 37*c* under suction of the cooling fan 27.

The first air flow a is directed back in front of the air intake chamber 28 and flows through the short inlet tube 28*a* into the air intake chamber 28. When the first air flow a thus abruptly reverses its direction of flow just before flowing into the air intake chamber 28, sea water spray, dust or other foreign matter contained in the air is separated and does not enter the air intake chamber 28.

Air introduced into the air intake chamber 28 is then discharged through the short outlet tube 28*b* and drawn through the air conduit 51 into the carburetor 35, in which air is mixed with fuel to form an air-fuel mixture that is drawn into the engine combustion chamber (FIG. 5).

The second air flow b flows from the cooling air inlet port 37*c* into the shroud 37 and is fed by the cooling fan 27 onto the entire outer surfaces of the internal combustion engine 13 and the carburetor 35. After having cooled the internal combustion engine 13 and the carburetor 35, air is discharged downwardly through the clearance gap defined between the side surface of the internal combustion engine 13 and the surrounding wall 37*b* of the shroud 37 (FIG. 1).

According to the cover assembly 14 of the outboard engine, therefore, air flowing into the cavity 14*a* in the cover assembly 14 from the air inlet port 40*c* in the upper cover 40 is divided into an air flow to be drawn into the engine and an air flow to cool the engine. The air flow to be drawn into the engine therefore is not shbjected to the heat generted by the engine body, with the result that the charging efficiency of the engine is increased and hence the power output thereof is also increased. Any air suction noise produced when air is drawn into the engine is attenuated in the air intake chamber 28 and also in the cavity 14*a* in the cover assembly 14. Accordingly, air suction noise which leaks out of the engine is greatly reduced. Since the air intake chamber 28 is installed in the space within the cavity 14*a* in the cover assembly 14, the engine can be rendered compact in size.

The air inlet tube 28*a* of the air intake chamber 14 is spaced remotely from the air inlet port 40*c* in the upper cover 40 and opens away from the air inlet port 40*c*. This arrangement causes the air flow to abruptly change or reverse its direction immediately before flowing into the air intake chamber 14, separating sea water spray, dust, or other foreign matter from the air flow. Therefore, sea water spray, dust, or other foreign matter is prevented from entering the engine combustion chamber by the simple air passage construction.

FIGS. 8 through 11 illustrate an outboard engine according to a second embodiment of the present invention. The outboard engine of the second embodiment is of the same construction as that of the outboard engine of the first embodiment except for an air intake system, or more paricularly, except for only an air intake chamber and a cover assembly. Those parts which are identical with the corresponding parts of the first embodiment will not be described in detail. Identical or corresponding parts in FIGS. 8 through 11 are denoted by identical or corresponding reference characters in FIGS. 1 through 7.

As shown in FIGS. 8 through 11, an air intake chamber 28 communicating with an engine carburetor 35 is disposed in a cavity 14*a* in a cover assembly 14. The carburetor 35 mounted on a cylinder barrel 32 is positioned in a rear rightward projecting portion 37*d* of a shroud 37. An air intake chamber 28 is complementarily fitted in a substantially wedge-shaped (as viewed in plan) space positioned in front of the projecting portion 37*d* and defined by a surrounding wall of the shroud 37 and a righthand portion of a surrounding wall of a lower cover 41.

The air intake chamber 28 has a short inlet tube 28*a* for introducing air therethrough, a short outlet tube 28*b* for discharging air therethrough, and a fuel reservoir 28*c*. The short inlet tube 28*a* projects upwardly from an upper surface of the air intake chamber 28 and opens toward the surrounding wall of the shroud 37. The fuel reservoir 28*c* is formed on a front wall of the air intake chamber 28 which faces forward of the outboard engine, and projects outwardly from a body of the air intake chamber 28. The fuel reservoir 28*c* serves to receive any fuel overflowing from a fuel nozzle in the carburetor 35 and prevent such fuel from flowing out of the short inlet tube 28*a* when the power unit is tilted over the boat at the time of tilting up the propeller. The short outlet tube 28*b* is located on a rear end of the air intake chamber 28 and projects through an air discharge port 37*f* defined in the projecting portion 37*d* of the shroud 37 into the shroud 37 toward a position close to the carburetor 35.

The air intake chamber 28 has an integral support pin 47 with an enlarged head, disposed on an upper surface adjacent to the short inlet tube 28*a*. A support arm 48 pivotally attached to the shroud 37 has an U-shaped recess 48*a*. The support pin 47 has a neck engaging in the U-shaped recess 48*a*. Thus, the air intake chamber 28 is secured to the cover assembly 14 by the support arm 48.

As shown in FIGS. 9 and 10, the carburetor 35 and the air intake chamber 28 are held in communication with each other by an air conduit 51 having one end fastened by bolts 52 to the carburetor 35, a bent intermediate portion, and an opposite end directed forward of the outboard engine and coupled by a rubber joint 53 to the short outlet tube 28*b* of the air intake chamber 28.

Figure 8:
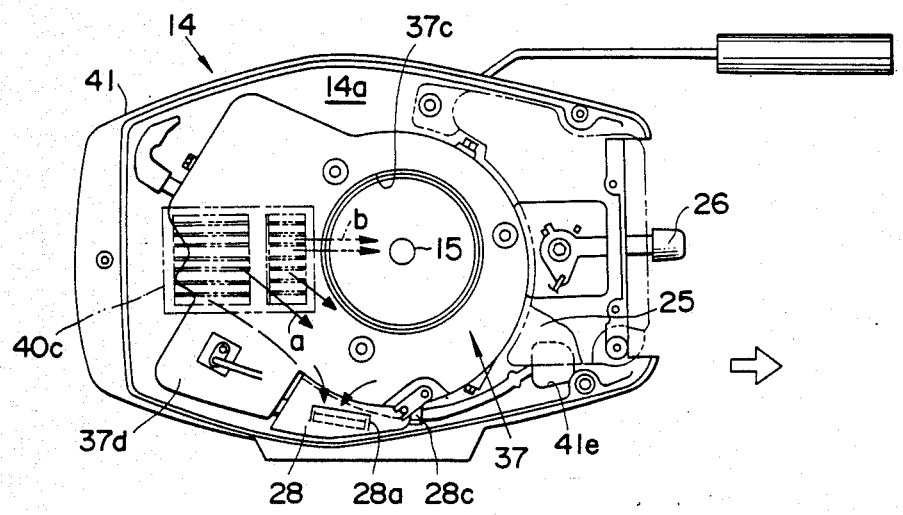
FIG. 8 is a plan view illustrative of the interior of a cover assembly of an outboard engine according to a second embodiment of the present invention.

The cover assembly 14 of the outboard engine according to the second embodiment is of the same construction as that of the cover assembly 14 of the first embodiment except that the lower cover 41 has an additional air inlet port 41*e*, as shown in FIG. 8. An air inlet port 40*c* defined in a rear portion of the top wall of an upper cover will be referred to as a main air inlet port, while the additional air inlet port 41*e* will be referred to as an auxiliary air inlet port. The auxiliary air inlet port 41*e* is defined in a front portion of the bottom wall of the lower cover in confronting relation to the lower surface of a fuel tank 25.

With the cover assembly thus constructed, as shown in FIG. 8, the short inlet tube 28*a* of the air intake chamber 28 is positioned away from the main and auxiliary air inlet ports 40*c*, 41*e*. During operation of the internal combustion engine 13, air is introduced through the main air inlet port 40*c* in the upper cover into the cavity 14*a* in the cover assembly 14 and is divided into a first air flow a directed obliquely toward the air intake chamber 28 under suction of the internal combustion engine 13 and a second air flow b directed straight toward a cooling air inlet port 37*c* in the shroud 37 under suction of a cooling fan.

As shown in FIG. 11, the first air flow a flows downwardly along the surrounding wall 37*b* of the shroud 37, and is directed horizontally through the short inlet tube 28*a* into the air intake chamber 28. When the first air flow a thus goes along a crank-shaped path just before flowing into the air intake chamber 28, sea water spray, dust or other foreign matter contained in the air is separated and does not enter the air intake chamber 28.

Air introduced into the air intake chamber 28 then flows in the same manner as described with reference to the first embodiment. The second air flow b flows through the cooling air inlet port 37*c* into the shroud 37, and thereafter flows in the same manner as described with reference to the first embodiment.

With the cover assembly 14 according to the second embodiment, air also flows into the cavity 14*a* in the cover assembly 14 through the auxiliary air inlet port 41*e* in the lower cover 41 and is combined with the first air flow a from the main air inlet port 40*c*, the combined air flow being drawn into the short inlet tube 28*a* of the air intake chamber 28. At this time, air flowing from the auxiliary air inlet port 41*e* into the lower cover 41 first goes upwardly along the surrounding wall 37*b* of the shroud 37, and then is directed horizontally toward the short inlet tube 28*a* of the air intake chamber 28. When the air flow changes its direction, sea water spray, dust, or other foreign matter is separated from the air flow and prevented from entering the air intake chamber 28.

According to the cover assembly 14 of the outboard engine of the second embodiment, therefore, air flowing into the cavity 14*a* in the cover assembly 14 through the air inlet ports is divided into an air flow to be drawn into the engine and an air flow to cool the engine. The air flow to be drawn into the engine is introduced into the air intake chamber while ventilating the interior of the lower cover 41, and is not subjected to the heat generated by the engine body, but is kept at a relatively low temperature at all times, with the result that the charging efficiency of the engine is increased and hence the power output thereof is also increased. Any air suction noise produced when air is drawn into the engine is attenuated in the air intake chamber 28 and also in the cavity 14*a* in the cover assembly 14. Accordingly, air suction noise which leaks out of the engine is greatly reduced. Since the air intake chamber 28 is installed in the space within the cavity 14*a* in the cover assembly 14, the engine can be rendered compact in size.

The air inlet tube 28*a* of the air intake chamber 14 is spaced remotely from the main and auxiliary air inlet ports 40*c*, 41*e* and opens toward the surrounding wall 37*b* of the shroud 37. This arrangement causes the air flow to change its direction immediately before flowing into the air intake chamber 28 through the air inlet port 28*a*, separating sea water spray, dust, or other foreign matter from the air flow. Therefore, the wall surface of the shroud 37 provides a labyrinth path to prevent sea water spray, dust, or other foreign matter from entering the engine combustion chamber.

Although there have been described what are at present considered to be the preferred embodiment of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

We claim:

1. An outboard engine comprising:

(a) a power unit;

(b) an extension case extending vertically and having the upper end thereof coupled to said power unit;

(c) a propeller mounted on the lower end of said extension case and driven by said power unit;

(d) a handlebar mounted on said power unit;

(e) said power unit comprising:

an internal combustion engine; and a cover assembly covering said internal combustion engine;

(f) said cover assembly having a foot on one side thereof to form a base for laying down the outboard engine;

(g) said internal combustion engine having a generally vertically extending crankshaft and a cylinder having an axis generally horizontal and perpendicular with respect to said crankshaft and the axis of said cylinder being inclined to another side with respect to the axis of said propeller when viewed in plan, said cylinder axis being inclined away from the side of the cover assembly having said foot, said internal combustion engine having no cylinders which are not inclined to said another side with respect to the axis of said propeller; and (h) said handlebar being disposed on a side of said power unit toward which the axis of said cylinder is inclined.

2. The outboard engine of claim 1, wherein said internal combustion engine has an oil pan containing engine oil, said cylinder being so inclined that said engine oil from said oil pan is prevented from entering said cylinder when the outboard engine is laid down on said foot.

3. An outboard engine comprising:

(a) a power unit;

(b) an extension case extending vertically and having the upper end thereof coupled to said power unit;

(c) a propeller mounted on the lower end of said extension case and driven by said power unit;

(d) a handlebar mounted on said power unit;

(e) said power unit comprising:

an internal combustion engine having a vertically extending crank shaft and a cylinder having the axis thereof extending horizontally; and a cover assembly covering said internal combustion engine;

(f) said cover assembly having a foot on one side thereof to form a base for laying down the outboard engine;

(g) the axis of said cylinder being inclined to another side with respect to the axis of said propeller when viewed in plan, said cylinder axis being inclined away from the side of the cover assembly having said foot;

(h) said handlebar being disposed on a side of said power unit toward which the axis of said cylinder is inclined; and wherein said cover assembly is in the form of a shell defining a cavity therein, said crankshaft is provided with an engine cooling fan mounted on the upper end thereof, and said cover assembly has a shroud formed integrally on a lower surface thereof, said shroud cooperating with said engine cooling fan for cooling said internal combustion engine, and wherein said cover assembly has at least one air inlet port for introducing air therethrough into said cavity, a cooling air inlet port for introducing air therethrough from said cavity into said shroud, and an air discharge port for introducing air therethrough from said cavity into said internal combustion engine.

4. An outboard engine according to claim 3, wherein;

said cover assembly is in the form of a shell defining a cavity therein, said crank shaft is provided with an engine cooling fan mounted on the upper end thereof, and said cover assembly has a shroud formed integrally on a lower surface thereof, said shroud cooperating with said engine cooling fan for cooling said internal combustion engine.

5. An outboard engine of claim 3, wherein said internal combustion engine has a carburetor and an air intake chamber, both disposed at a side of said internal combustion engine opposite to the side to which the cylinder in inclined.

6. An outboard engine of claim 3, wherein said internal combustion engine has a carburetor and an air intake chamber, both disposed at a side of said internal combustion engine opposite to the side to which the cylinder is inclined.

7. An outboard engine of claim 6, wherein said internal combustion engine has a carburetor and an air intake chamber, both disposed at a side of said internal combustion engine opposite to the side to which the cylinder is inclined.

8. An outboard engine according to claim 3, wherein:

said internal combustion engine has a carburetor, said shroud has a top wall and a surrounding wall and covers said engine, and said cooling fan and said carburetor from above, and said cooling air inlet port is defined in said top wall of said shroud.

9. An outboard engine according to claim 8, wherein:

said internal combustion engine is provided with an air intake chamber which is disposed in said cavity between a side wall of said cover assembly and said surrounding wall of said shroud, said air intake chamber has an air inlet for drawing air therethrough into said air intake chamber and an air outlet for discharging air therethrough into said carburetor, said air discharge port is defined in said side wall of said shroud, and said air outlet of said air intake chamber is projecting outwardly from said cavity through said air discharge port.

10. An outboard engine according to claim 9, wherein:

said air inlet port of said cover assembly is defined in a top wall of said cover assembly, and said air inlet of said air intake chamber is positioned at a location on said air intake chamber relatively remote from said air inlet port and opens away from said air inlet port.

11. An outboard engine according to claim, 10 wherein:

said cover assembly is composed of an upper cover and a lower cover, said upper cover having said air inelt port, and said lower cover having said shroud.

12. An outboard engine according to claim 9, wherein:

said cover assembly has first and second air inlet ports, said first air inlet port being defined in a top wall of said cover assembly, said second air inlet port being defined in a bottom wall of said cover assembly, and said air inlet of said air intake chamber is positioned at a location on said air intake chamber relatively remote from said first and second air inlet ports and opens in confronting relation to said surrounding wall of said shroud.

13. An outboard engine according to claim 12, wherein:

said cover assembly is composed of an upper cover and a lower cover, said upper cover having said first air inlet port, and said lower cover having said second air inlet port and said shroud.

14. An outboard engine comprising:

(a) a power unit;

(b) an extension case extending vertically and having the upper end thereof coupled to said power unit;

(c) a propeller mounted on the lower end of said extension case and driven by said power unit;

(d) said power unit comprising:

an internal combustion engine having a generally vertically extending crankshaft, a cylinder having the axis thereof extending generally horiziontally, and an oil pan containing engine oil; and a cover assembly covering said internal combustion engine;

(e) said cover assembly having a foot on one side thereof to form a base for laying down the outboard engine; and (f) the axis of said cylinder being inclined to another side with respect to the axis of said propeller, said cylinder axis being inclined away from the side of the cover assembly having said foot, thereby the engine oil in said oil pan is prevented from entering said cylinder when the outboard engine is laid down on said foot, said internal combustion engine having no cylinders which are not inclined to said another side with respect to the axis of said propeller.

15. An outboard engine of claim 14, further comprising a handlebar mounted on said power unit, said handlebar being disposed on a side of said power unit toward which the axis of said cylinder is inclined.

16. An outboard engine according to claim 14, wherein:

said cover assembly is in the form of a shell defining a cavity therein, said crank shaft is provided with an engine cooling fan mounted on the upper end thereof, and said cover assembly has a shroud formed integrally on a lower surface thereof, said shroud cooperating with said engine cooling fan for cooling said internal combustion engine.

17. An outboard engine according to claim 14, wherein:

said cover assembly has at least one air inlet port for inroducing air therethrough into said cavity, a cooling air inlet port for introducing air therethrough from said cavity into said shroud, and an air discharge port for introducing air therethrough from said cavity into said internal combustion engine.

18. An outboard engine according to claim 17, wherein:

said internal combustion engine has a carburetor, said shroud has a top wall and a surrounding wall and covers said engine, said cooling fan and said carburetor from above, and said cooling air inlet port is defined in said top wall of said shroud.

19. An outboard engine according to claim 17, wherein:

said cover assembly is composed of an upper cover and a lower cover, said upper cover having said air inlet port, and said lower cover having said shroud.

20. An outboard engine according to claim 17, wherein:

said internal combustion engine is provided with an air intake chamber which is disposed in said cavity between a side wall of said cover assembly and said surrounding wall of said shroud, said air intake chamber has an air inlet for drawing air therethrough into said air intake chamber and an air outlet for discharging air therethrough into said carburetor, said air discharge port is defined in said side wall of said shroud, and said air outlet of said air intake chamber is projecting outwardly from said cavity through said air discharge port.

21. An outboard engine according to claim 20, wherein:

said air inlet port of said cover assembly is defined in a top wall of said cover assembly, and said air inlet of said air intake chamber is positioned at a location on said air intake chamber relatively remote from said air inlet port and opens away from said air inlet port.

22. An outboard engine according to claim 20, wherein:

said cover assembly has first and second air inlet ports, said first air inlet port being defined in a top wall of said cover assembly, said second air inlet port being defined in a bottom wall of said cover assembly, and said air inlet of said air intake chamber is positioned at a location on said air intake chamber relatively remote from said first and second air inlet ports and opens in confronting relation to said surrounding wall of said shroud.

23. An outboard engine according to claim 22, wherein said cover assembly is composed of an upper cover and a lower cover, said upper cover having said first air inlet port, and said lower cover having said second air inlet port and said shroud.

* * * * *